US006146566A

United States Patent [19]

Beeck et al.

[11] Patent Number: 6,146,566

[45] Date of Patent: Nov. 14, 2000

[54] PROCESS AND DEVICE FOR TRANSPORTING VAPOR THROUGH AT LEAST ONE ROUND SPINNING NOZZLE CASING

[75] Inventors: Heinz-Dieter Beeck; Thomas Gries, both of Frankfurt am Main; Andreas Mueller, Floersheim-Dalsheim, all of Germany

[73] Assignee: Lurgi Zimmer Aktiengesellschaft, Frankfurt am Main, Germany

[21] Appl. No.: 09/274,584

[22] Filed: Mar. 23, 1999

[30] Foreign Application Priority Data

Jul. 8, 1998 [DE] Germany ..... 198 30 453

[51] Int. Cl.[7] ..... D01D 5/092; D01F 6/60

[52] U.S. Cl. ..... 264/101; 264/211.14; 425/72.2; 425/73; 425/192 S

[58] Field of Search ..... 264/101, 211.14; 425/72.2, 73, 192 S

[56] References Cited

U.S. PATENT DOCUMENTS 4,702,871 10/1987 Hasegawa et al. ..... 264/101
5,370,833 12/1994 Wellenhofer et al. ..... 264/101

FOREIGN PATENT DOCUMENTS 581 145 B1 10/1997 European Pat. Off. .

OTHER PUBLICATIONS

Franz Fourné . *Synthetische Fasern.* Carl–Hanser–Verlag: Munich, 1995, pp. 64, 348,362.
Rogowin. *Chemiefasern.* Georg Thieme Verlag: Stuttgart, p. 221(1982).

*Primary Examiner*—Leo B. Tentoni
*Attorney, Agent, or Firm*—McDonnell Boehnen Hulbert & Berghoff

[57] ABSTRACT

The invention provides a process and device for the spinning of polyamides including transporting vapor through at least one round spinning nozzle casing (5) using an exhaust device (14, 15) that is positioned under at least one round spinning nozzle plate (10).

In this process, the vapor is injected tangentially into the upper portion of the applicable spinning nozzle casing (5) and is conducted downward through at least one helical groove (7), which is arranged along the exterior of the applicable spinning nozzle unit (6). The vapor at the lower end of the spinning nozzle unit (6) is conducted against a circular, horizontally positioned groove (8), where it undergoes a change in the direction of flow toward the spinning nozzle plate (10). The vapor is then conducted to the spinning nozzle plate (10) over the inner edge (9) of the circular, horizontally positioned groove (8) and through a first annular passage (11) and, at the spinning nozzle plate (10), is suctioned off by the exhaust device (14, 15) through a second annular passage (12).

12 Claims, 2 Drawing Sheets

FIGURE 2
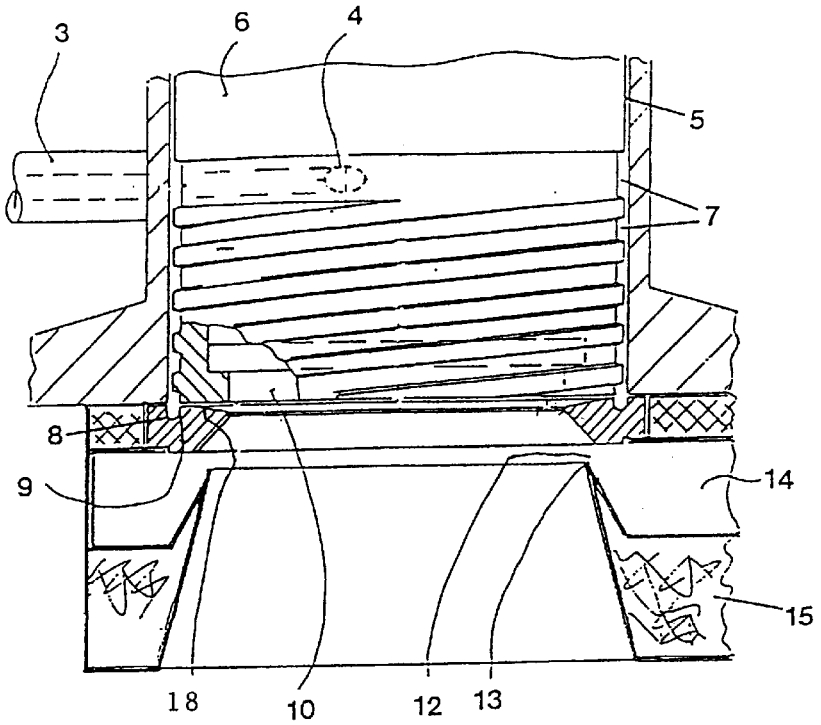
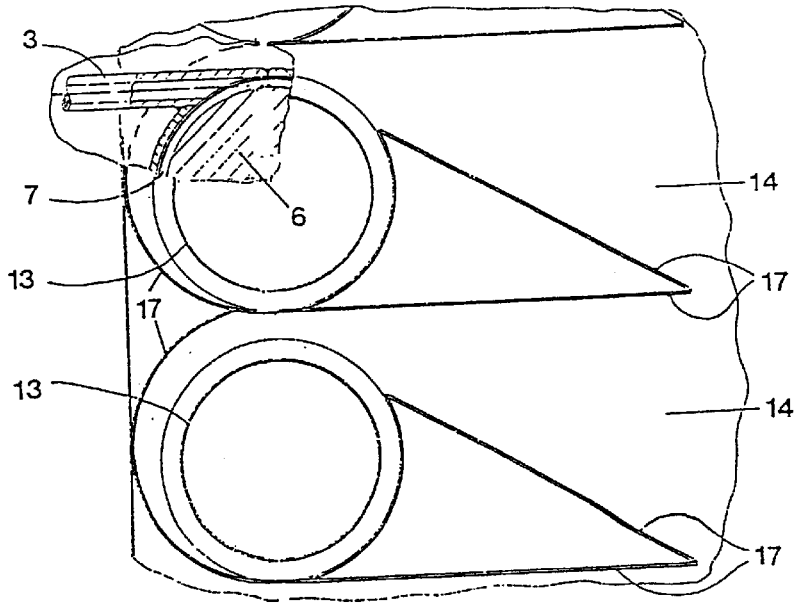
FIGURE 3

PROCESS AND DEVICE FOR TRANSPORTING VAPOR THROUGH AT LEAST ONE ROUND SPINNING NOZZLE CASING

BACKGROUND OF THE INVENTION

1. Field of the Invention

The invention relates to a process and device for the spinning of polyamides, like PA 6 and PA 6.6, comprising transporting vapor through at least one round spinning nozzle casing using an exhaust device positioned under at least one round spinning nozzle plate.

2. Summary of the Related Art

Processes and devices for transporting steam through spinning nozzle casings are known. Franz Fourne, Synthetische Fasern [Synthetic Fibers], Carl Hanser Verlag [Carl Hanser Publishing] Munich, Vienna 1995, pages 64, 348 and 362, states that it is advantageous to coat a spinning nozzle with steam that is generally superheated. This increases the cleanliness and usability of the undersides of the spinning nozzles by a factor of about two to four. Apparently, coating of spinning nozzles in this manner is particularly advantageous when spinning polyamide (PA) 6.6 fibers.

EP-B0 581 145 describes a process and device for manufacturing fibers that emit noxious gases and/or vapor during spinning. This process includes, among other features, a provision for removing the noxious gases and/or vapors produced during this process from the device and feeding them into a gas purification system.

It is known, according to Rogowin, Chemiefasem [Chemical Fibers], Georg Thieme Verlag [Georg Thieme Publishing] Stuttgart, New York, page 221, that the polymerization reaction of caprolactam is an equilibrium reaction and that the lactam remaining in the polymer, which boils at 258° C., is very detrimental to spinning conditions. This is due to the fact that the lactam vapors can produce fiber breakage when they are released from the spinning nozzles together with the polymer melt. Similar disadvantages are also found in relation to the spinning of polyamide 6.6 fibers.

In addition, it is generally known that round spinning heads with round spinning nozzle plates can be used when spinning polyamide 6 or polyamide 6.6 fibers.

SUMMARY OF THE INVENTION

The present invention comprises a process for transporting vapor through at least one round spinning nozzle casing for the spinning of polyamides, like PA 6 and PA 6.6 using an exhaust device positioned under at least one round spinning nozzle plate, which process ensures that vapor is applied to the exterior of the applicable spinning nozzle unit in as homogeneous a manner as possible to obtain as homogeneous a coating of the underside of the spinning nozzle as possible. At the same time, the invention is designed to ensure that the noxious lactam vapors or evaporating compounds can be almost completely extracted firm the device, together with the vapor, directly at the undersides of the spinning nozzles. The invention further provides a device to perform this process.

BRIEF DESCRIPTION OF THE DRAWINGS

FIG. 2 depicts a cross-section of another embodiment of the spinning head with an exhaust device positioned underneath a spinning nozzle plate.

FIG. 3 depicts a view from above of the exhaust gas channel with positioned guide plates.

DETAILED DESCRIPTION OF THE PREFERRED EMBODIMENTS

Figure 1:
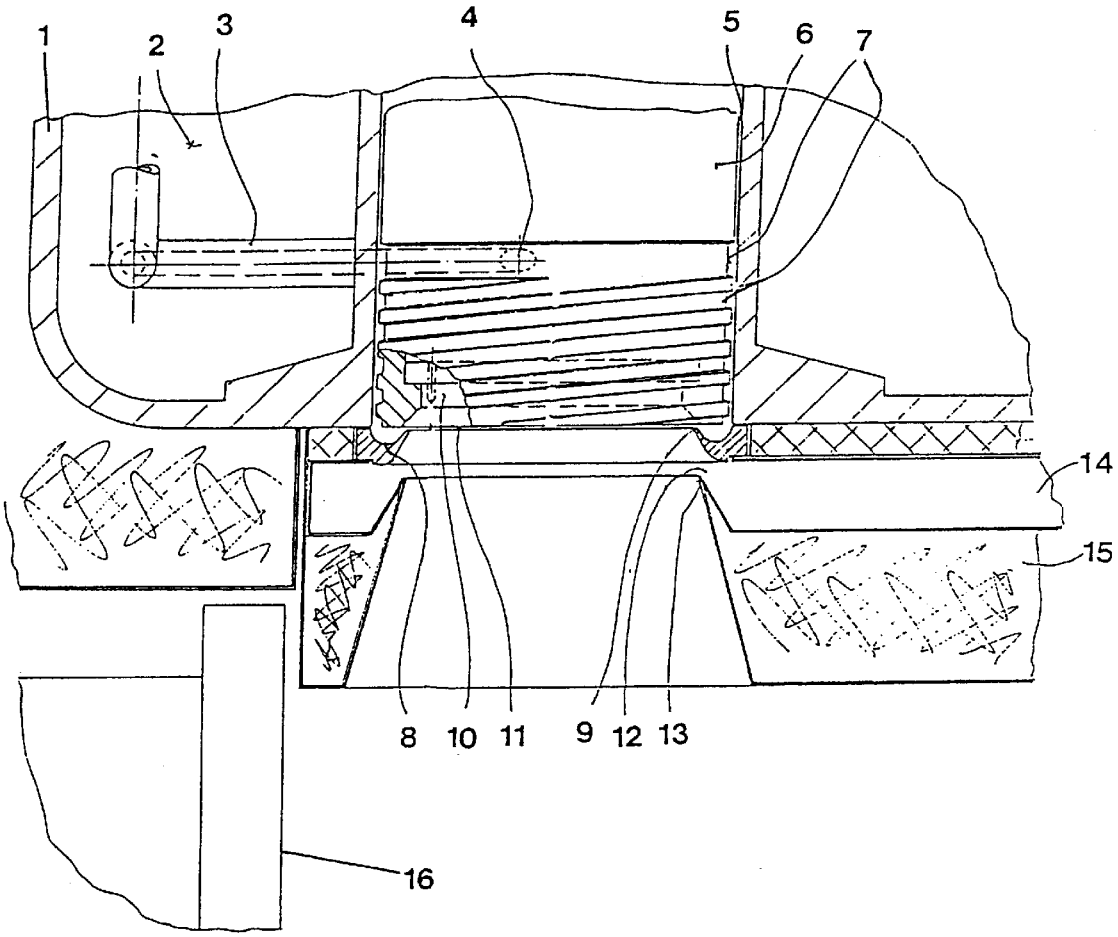
FIG. 1 depicts a cross-section of a spinning head with an exhaust device positioned underneath a spinning nozzle plate.

The present invention comprises a process for the spinning of polyamides, like PA 6 and PA 6.6, which process comprises transporting vapor through at least one round spinning nozzle casing using an exhaust device positioned under at least one round spinning nozzle plate, wherein the vapor is injected tangentially into the upper portion of said spinning nozzle casing and is conducted downward through at least one helical groove positioned around the exterior of the applicable spinning nozzle unit, and wherein the vapor at the lower end of the spinning nozzle unit is conducted against a circular, horizontally positioned groove where it undergoes a change in the direction of flow toward the spinning nozzle plate, whereby the vapor is conducted to the spinning nozzle plate over the inner edge of the circular, horizontally positioned groove via a first annular passage and is horizontally suctioned off through a second annular passage at the spinning nozzle plate by the exhaust device.

The term "vapor" as used herein is defined as water vapor or the vapor of aqueous solutions that can be evaporated without residues. Each spinning nozzle casing is designed as a hollow cylinder. A spinning nozzle unit, which is also cylindrical and which secures a round spinning nozzle plate in its lower portion, is arranged in each spinning nozzle casing. It is generally preferred to arrange two helical grooves around the applicable spinning nozzle unit such that the vapor is conducted downward in two partial flows. The helical grooves should be positioned so that they are staggered in relation to one another. The helical groove or grooves can consist, for example, of a round, rectangular, triangular, or polygonal groove.

The process according to the invention allows the uniform application of vapor to the exterior of the applicable spinning nozzle unit. The bulk portion of the vapor flows tangentially to the exterior surface of spinning nozzle unit through the helical groove from the upper portion of the spinning nozzle unit to the lower portion of the spinning nozzle unit, which facilitates uniform temperature distribution as required in the spinning nozzle unit. As a result of the impact of the vapor at the lower end of the spinning nozzle unit against the circular, horizontally positioned groove, the direction of flow is redirected inward toward the spinning nozzle plate, and the underside of the spinning nozzle plate is uniformly coated with steam over the upper inner edge of the circular, horizontally positioned groove.

The circular, horizontally positioned groove should advantageously be designed without an edge inside the groove, thereby exhibiting the cross-section of a rounded trough. This upper inner edge of the circular, horizontally positioned groove forms a first annular passage directly underneath the spinning nozzle plate, thereby allowing for the relatively powerful application of vapor to the underside of said spinning nozzle plate. If several helical grooves are employed, vapor is applied to said spinning nozzle plate from individual partial streams at several different points.

A second annular groove arranged directly underneath the first annular groove at a distance of, for example, 5 to 25 mm, belongs to the exhaust device and is delimited by a circular, horizontally positioned collar or shroud. Thus, the vapor located at the spinning nozzle plate is directly suctioned off through the second annular groove at the smallest possible distance from the underside of the spinning nozzle plate. In this manner, the undesirable lactam vapor and/or other vaporizing compounds are removed from the device together with the vapor, thereby preventing it from reaching the blowing shaft underneath the exhaust device and contaminating the actual spinning process.

The exhaust device is advantageously connected, either in a fixed or detachable manner, to the hot spinning nozzle unit in at least one location, with the advantage consisting in the fact that the exhaust channel of the exhaust device is heated by thermal conduction from the spinning nozzle unit, so that precipitation of the lactam vapors and/or evaporating compounds in the exhaust channel is avoided.

The at least one helical groove can be worked out, for example, directly into the nozzle casing, in which case it is important to ensure that the exterior of the spinning nozzle unit exhibits a smooth outside surface.

In a preferred embodiment of the invention, the vapor is conducted through at least one helical groove installed on the exterior surface of the spinning nozzle unit. This ensures that the helical groove can be designed in a relatively simple manner. At the same time, this design facilitates relatively easy cleaning of the helical groove by temporary removing the spinning nozzle unit. If the helical groove were worked out, for example, into the spinning nozzle casing, cleaning the helical groove would be possible only with considerable effort.

According to an additional embodiment of the invention, the vapor is conducted through at least one helical groove that consists of a trapezoidal thread. It is particularly advantageous if the trapezoidal thread is designed as a flat trapezoidal thread. Trapezoidal threads generally do not have very sharp corners and edges, which has an advantageous effect on the transport of vapor through the one or more helical grooves. At the same time, soiling of the one or more helical grooves is kept to a minimum. To the extent that the intention is to include several helical grooves, it is advantageous to employ multiple trapezoidal threads. This is advantageous because the vapor being conducted downward through the helical grooves hits the circular, horizontally positioned groove underneath the spinning nozzle plate in the form of several partial flows, at several points, which facilitates the uniform application of vapor to the spinning nozzle plate. As a rule, it is generally sufficient to employ two trapezoidal threads so that the vapor is divided into two separate partial flows.

According to another preferred embodiment of the invention, the vapor, once it has passed the inner edge of the circular, horizontally positioned groove, is conducted to the spinning nozzle plate over an annular surface that runs radially inward and sloping downward. The radial sloping downward annular surface forms a channel that acts advantageously on the flow along the spinning nozzle plate, which then progresses essentially in parallel to the spinning nozzle plate.

According to another preferred embodiment of the invention, the direction of vapor flow is set in the exhaust device by means of guide panels. It is advantageous to feed the steam enriched with lactam and/or other evaporating compounds from the exhaust channel of the exhaust device into an exhaust gas collection line, especially when several spinning heads arc arranged adjacent to one another in a single unit.

The invention further provides a spinning head device comprising:

a vapor supply line that is tangentially connected to at least one cylindrical spinning nozzle casing having upper and lower portions, wherein the connection is in the upper portion of the casing, one spinning nozzle unit with a round spinning nozzle plate per spinning nozzle casing, wherein the spinning nozzle unit has upper and lower portions corresponding to the upper and lower portions of the casing, and wherein the spinning nozzle plate is located in the lower portion of the spinning nozzle unit, at least one helical groove arranged around the spinning nozzle unit, wherein the helical groove has a first end in the region of the upper portion of the spinning nozzle unit and a second end in the region of the lower portion of the spinning nozzle unit, a horizontally positioned circular groove located directly underneath the second end of the helical groove and arranged directly underneath each spinning nozzle unit lower portion and delimiting a first annular passage between the circular groove and the nozzle plate, an exhaust device arranged underneath the lower portion of the spinning nozzle, wherein the exhaust device comprises a circular, horizontally positioned collar located under the horizontally positioned circular groove, and delimiting a second annular passage between the collar and the nozzle plate.

The circular, horizontally positioned collar forms the second annular passage through which the vapor enriched with lactam and/or other evaporating compounds are suctioned off through the exhaust device. At the same time, the invention advantageously ensures that vapor uniformly surrounds the exterior of the spinning nozzle unit and is uniformly applied to the nozzle plate, thereby considerably increasing the serviceable life of the spinning nozzle plates. The exhaust device is connected, either in a fixed or detachable manner, to the spinning nozzle unit in at least one location, thereby advantageously ensuring that the exhaust channel of the exhaust device is heated by thermal conduction.

According to a further embodiment of the invention, the helical groove, of which there is at least one, is arranged on the outside of each spinning nozzle unit. This can be achieved relatively easily and advantageously, as the spinning nozzle unit is relatively easily accessible.

According to another embodiment of the invention, the at least one helical groove consists of at least one trapezoidal thread arranged on the exterior of each spinning nozzle unit. The use of multiple flat trapezoidal threads is advantageous, with a two-threaded flat trapezoidal thread having proven to be particularly effective.

In another embodiment of the invention, an annular surface running radially inward and sloping downward is arranged adjacent to the circular, horizontally positioned groove. The sloping downward annular surface forms a channel that optimizes the conditions of flow.

According to another embodiment of the invention, the exhaust device is detachably connected to the spinning head. It is particularly advantageous if the exhaust device is secured by means of spring-loaded hinges and can be swung away underneath the spinning nozzle unit. However, it is also possible to pivot the exhaust device on ball and socket joints. If the exhaust device is detachably connected to the spinning head, access to the individual spinning nozzles for maintenance purposes is easily possible. At the same time, heating the exhaust channels by thermal conduction during spinning is provided.

According to another embodiment of the invention, guide plates for the vapor are arranged in the exhaust device. The vapor can be diverted in the desired direction by means of the guide plates, so that it can be relatively easily conducted into an exhaust gas collection line.

The invention is described in further detail based on the drawings (FIG. 1–3):

FIG. 1 depicts a cross-section of a spinning head with an exhaust device (14, 15) positioned underneath a spinning nozzle plate (10). A cylindrical spinning nozzle unit (6) is arranged in the spinning nozzle casing (5), which is arranged on the spinning bar (1). The spinning nozzle unit (6) contains a round spinning nozzle plate (10) in its lower portion. The vapor is supplied through the supply line (3), which runs through the heating space (2) of the device and enters the upper portion of the spinning nozzle casing (5) tangentially through the vapor outlet (4). From that position, the vapor is conducted from the first end of the helical groove (7) downward along the helical groove (7) on the exterior of the spinning nozzle unit (6). The helical groove (7) is formed by a trapezoidal thread arranged on the exterior of the spinning nozzle unit (6). At the lower end of the spinning nozzle unit (6), the vapor is conducted from the second end of the helical groove (7) against a circular, horizontally positioned groove (8), where it experiences a change in its direction of flow inward toward the spinning nozzle plate (10). The vapor ultimately reaches the spinning nozzle plate (10) over the inner edge (9) of the circular, horizontally positioned groove (8) and through a first annular passage (11). The vapor is then suctioned horizontally away from the spinning nozzle plate (10) through a second annular passage (12) by the exhaust device (14, 15). The exhaust device (14, 15) essentially consists of the exhaust channel (14) and the insulation (1 5). The second annular passage (12) is formed by the circular collar (13), which forms part of the insulation (15) and, consequently, part of the exhaust device (14, 15). The vapor enriched with lactam and/or other evaporating compounds are removed from the device through the exhaust channel (14), thus preventing them from reaching the blowing channel (16) and adversely affecting the spinning of PA-6 or PA-6.6 fibers.

An alternative spinning head with an exhaust device (14, 15) arranged underneath the spinning nozzle plate (10) is depicted in FIG. 2. Once it has passed the inner edge (9), the vapor is conducted to the spinning nozzle plate (10) over an annular surface (18), which runs radially inward and sloping downward. The annular surface (18) forms a channel that optimizes the conditions of flow.

FIG. 3 depicts a view from above of the exhaust channel (14) with the guide plates (17) arranged in the exhaust channel (14). The plates (17) arc arranged in such a way that the vapor enriched with lactam and/or other evaporating compounds entering the exhaust channel (14) can be diverted as desired and conducted into a collection line (not depicted). The arrangement of guide plates (17) is particularly advantageous if several spinning heads are arranged adjacent to one another and a single shared collection line for the vapor being suctioned off is provided.

We claim:

1. In a process for the spinning of polyamides, the improvement comprising transporting vapor through at least one round spinning nozzle casing to an exhaust device that is positioned under at least one round spinning nozzle contained within the casing, wherein the casing has an upper portion and a lower portion and the vapor is injected tangentially into the upper portion of said spinning nozzle casing and is conducted downward through at least one helical groove toward the lower portion of the casing, and wherein the groove is arranged along the exterior of the applicable spinning nozzle unit and the vapor at the lower portion of the spinning nozzle unit is conducted against a circular, horizontally positioned groove having an inner edge, wherein the vapor experiences a change in the direction of flow inward, over the inner edge of the circular, horizontally positioned groove toward the spinning nozzle via a first annular passage and is horizontally suctioned off at the spinning nozzle through a second annular passage by the exhaust device.

2. The process according to claim 1, wherein the vapor is conducted through at least one helical groove that is arranged on the exterior of the spinning nozzle unit.

3. The process according to claim 2, wherein the groove is comprised of a trapezoidal thread.

4. The process according to claim 1, wherein the vapor comprises steam, which, once it has passed the inner edge, is conducted to the spinning nozzle plate over an annular surface that runs radially inward and sloping downward.

5. The process according to claim 1, wherein the direction of flow of the vapor in the exhaust device is adjusted by means of guide plates.

6. A spinning head for performing the process according to claim 1, the spinning head comprising a) a vapor supply line that is tangentially connected to at least one cylindrical spinning nozzle casing having upper and lower portions, wherein the connection is in the upper portion of the casing, b) one spinning nozzle unit with a round spinning nozzle plate per spinning nozzle casing, wherein the spinning nozzle unit has upper and lower portions corresponding to the upper and lower portions of the casing, and wherein the spinning nozzle plate is located in the lower portion of the spinning nozzle unit, c) at least one helical groove arranged around the spinning nozzle unit, wherein the helical groove has a first end in the region of the upper portion of the spinning nozzle unit and a second end in the region of the lower portion of the spinning nozzle unit, d) a horizontally positioned circular groove located directly underneath the second end of the helical groove, arranged directly underneath each spinning nozzle unit lower portion, and delimiting a first annular passage between the circular groove and the nozzle plate, e) an exhaust device arranged underneath each spinning nozzle unit and comprising a circular, horizontally positioned collar located under the horizontally positioned circular groove and delimiting a second annular passage between the collar and the nozzle plate.

7. The spinning head according to claim 6, wherein at least one helical groove is arranged on the exterior of the corresponding spinning nozzle unit.

8. The spinning head according to claim 6, wherein the number of helical grooves is two.

9. The spinning head according to claim 7, wherein the groove is defined by a trapezoidal thread arranged on the exterior of the spinning nozzle unit.

10. The spinning head according to claim 6, wherein an annular surface running radially inward and sloping downward is arranged adjacent to the circular, horizontally positioned groove.

11. The spinning head according to claim 6, wherein the exhaust device is detachably connected to the spinning head.

12. The spinning head according to claim 6, further comprising guide plates located in the exhaust device guiding the vapor out of the spinning head.

* * * * *